US008096573B2

(12) United States Patent
Francois et al.

(10) Patent No.: US 8,096,573 B2
(45) Date of Patent: Jan. 17, 2012

(54) GLIDING BOARD WITH LATERAL RUNNING EDGES

(75) Inventors: Jérôme Francois, Aix les Balns (FR); Eric Pignol, Seynod (FR); Axel Phelipon, Duingt (FR); Aldric Bourgier, Vieugy (FR); Lionel Favret, Annecy (FR)

(73) Assignee: Salomon S.A.S., Metz-Tessy (FR)

( * ) Notice: Subject to any disclaimer, the term of this patent is extended or adjusted under 35 U.S.C. 154(b) by 553 days.

(21) Appl. No.: 12/130,014

(22) Filed: May 30, 2008

(65) Prior Publication Data

US 2009/0051142 A1 Feb. 26, 2009

(30) Foreign Application Priority Data

Jun. 1, 2007 (FR) ..... 07 03905

(51) Int. Cl.
*A63C 5/04* (2006.01)

(52) U.S. Cl. ..... 280/608; 280/609

(58) Field of Classification Search ..... 280/601, 280/607, 608, 609, 610, 841
See application file for complete search history.

(56) References Cited

U.S. PATENT DOCUMENTS

| | | | | | |
|---|---|---|---|---|---|
| 1,551,620 | A | * | 9/1925 | Ricke | 280/600 |
| 1,973,343 | A | * | 9/1934 | Hansen | 280/608 |
| 2,851,277 | A | | 9/1958 | Holmberg | |
| 3,272,522 | A | | 9/1966 | Kennedy, III | |
| 3,297,332 | A | | 1/1967 | Warner | |
| 3,329,437 | A | * | 7/1967 | Holmberg et al. | 280/610 |
| 3,352,566 | A | | 11/1967 | Kennedy, III | |
| 3,416,810 | A | | 12/1968 | Kennedy, III | |
| 3,580,596 | A | * | 5/1971 | Volkl | 280/608 |
| 3,705,729 | A | * | 12/1972 | Arnsteiner | 280/610 |
| 3,807,746 | A | * | 4/1974 | Kofler | 280/610 |
| 3,958,810 | A | * | 5/1976 | Bohm | 280/610 |
| 4,083,577 | A | * | 4/1978 | Ford | 280/609 |
| 4,175,767 | A | * | 11/1979 | Scheruebl | 280/610 |
| 5,451,276 | A | * | 9/1995 | Junius | 280/608 |
| 5,915,719 | A | * | 6/1999 | Bauvois | 280/607 |
| RE36,453 | E | * | 12/1999 | Abondance et al. | 280/609 |
| 6,059,306 | A | * | 5/2000 | Metrot et al. | 280/602 |
| 6,059,308 | A | | 5/2000 | Baudin et al. | |
| 6,406,054 | B1 | * | 6/2002 | Huyghe | 280/610 |

FOREIGN PATENT DOCUMENTS

| | | | |
|---|---|---|---|
| AT | 001 880 | U1 | 12/1997 |
| EP | 0 887 090 | A1 | 12/1998 |
| EP | 1 297 868 | A2 | 4/2003 |
| FR | 1 299 263 | A | 7/1962 |
| FR | 1 344 116 | A | 11/1963 |
| FR | 1 484 251 | A | 6/1967 |

* cited by examiner

*Primary Examiner* — Hau Phan
(74) *Attorney, Agent, or Firm* — Greenblum & Bernstein, P.L.C.

(57) ABSTRACT

The invention relates to a gliding board including a structural beam defining a longitudinal direction and having a gliding surface bordered on each side with a lateral running edge, each running edge having an edge body and an anchoring blade, the anchoring blades of the two running edges being oriented opposite one another. An inextensible connecting element locally connects the anchoring blades, at least along a portion at least of the length of the beam, and the connecting element is oriented in the extension of each of the blades.

22 Claims, 3 Drawing Sheets

Fig. 4
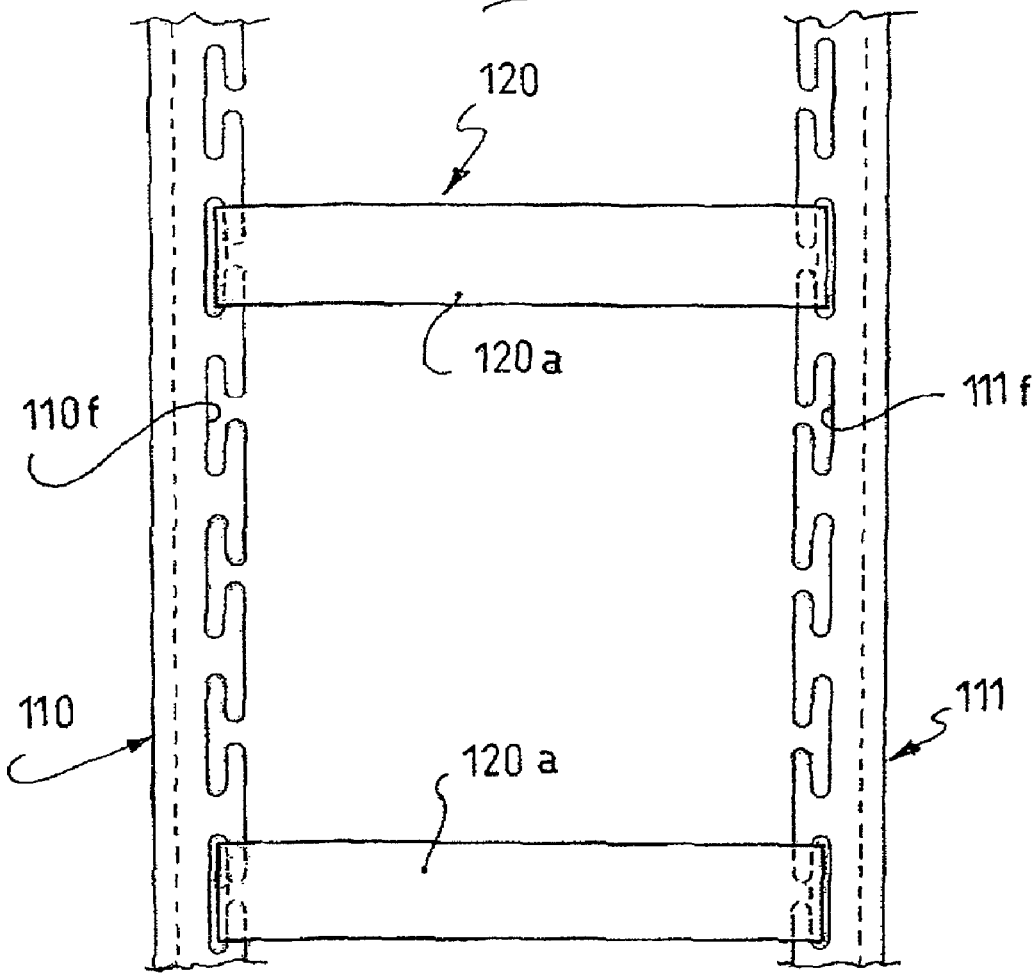
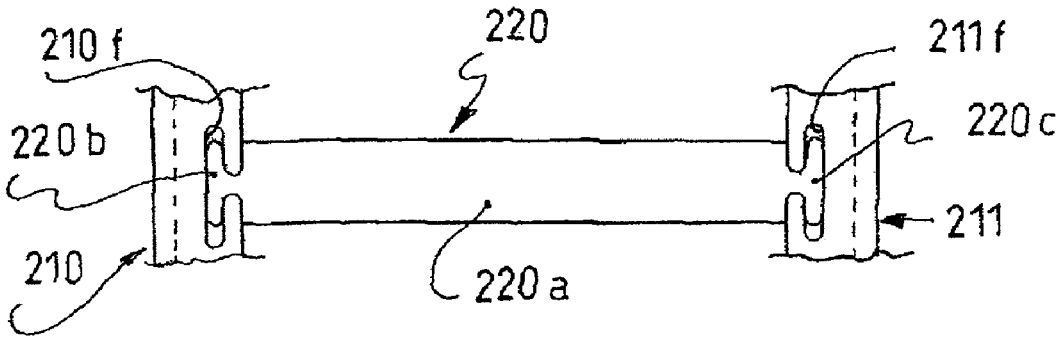
Fig. 5

GLIDING BOARD WITH LATERAL RUNNING EDGES

CROSS-REFERENCE TO RELATED APPLICATION

This application claims priority under 35 U.S.C. §119 of French Patent Application No. 07 03905, filed on Jun. 1, 2007, the disclosure of which is hereby incorporated by reference thereto in its entirety.

BACKGROUND OF THE INVENTION

1. Field of the Invention

The invention relates to a gliding board with lateral running edges. Such a gliding board can be an alpine ski or a snowboard, for example.

2. Description of Background and Other Information

In a known fashion, a ski has a composite structure, with a gliding sole, or bottom surface element, which is bordered by two lateral running edges. Generally, the running edges are metallic; each includes an edge body with two surfaces and a ridge that are visible from the outside. In the past, the running edges were screwed in place; they are now typically retained by an anchoring blade that is embedded in the ski structure.

The running edges must be flexible in order to follow the dimension lines of the ski, on the one hand, and to accompany the bending movements of the ski when gliding, on the other hand. Thus, the anchoring blades are usually perforated in order not to oppose much resistance to bending. Certain running edges are also made of butt-joined sections.

When the board is gliding, the running edges are subject to biases that are sometimes intense and rough, for example, when turning on frozen snow or when the ski contacts a stone. In such a case, there is a risk that the running edge may become separated or detached. Various means have been proposed to reinforce the embedding of the running edge in the ski structure. For example, the Utility Model AT001880U1 proposes curved anchoring tongues; the documents EP0887090 and EP1297868 propose projecting ribs or pins that are confined in the ski structure.

Another solution is described in U.S. Pat. No. 3,297,332, in which the two running edges are connected by bridge-shaped connecting bands that are embedded in the ski structure.

This latter construction method yields good results. Nevertheless, it is adapted to a ski structure and a geometry that are particular in terms of width and length. As a result, this solution is extremely complex and costly to implement, especially for a line of skis of various lengths, and it imposes on the designer a complete revision of the design of the ski in order to integrate the connecting bands therein. Furthermore, the construction method using bridge-shaped connecting bands does not offer the best resistance to running edge separation or detachment.

SUMMARY OF THE INVENTION

In view of the aforementioned state of the art, there is a need for a conventionally structured gliding board, in which resistance to running edge separation or detachment is improved.

Such improvement and other advantages, which will become apparent from the description that follows, are achieved by the present invention.

The gliding board according to the invention includes a structural beam having a gliding surface bordered on each side with a lateral running edge, each running edge having an edge body and an anchoring blade, the anchoring blades of the two running edges being oriented opposite one another, and each of the anchoring blades projecting from a respective edge body laterally inwardly within the beam.

According to the invention, an inextensible connecting element, also referred to as a connecting arrangement, connects the anchoring blades and is oriented in the extension of each of the blades.

BRIEF DESCRIPTION OF DRAWINGS

The invention will be better understood from the description that follows, with reference to the attached drawings, in which:

FIG. 4 relates to another embodiment of the invention;

FIG. 5 shows an alternative construction.

DETAILED DESCRIPTION OF THE INVENTION

Figure 1:
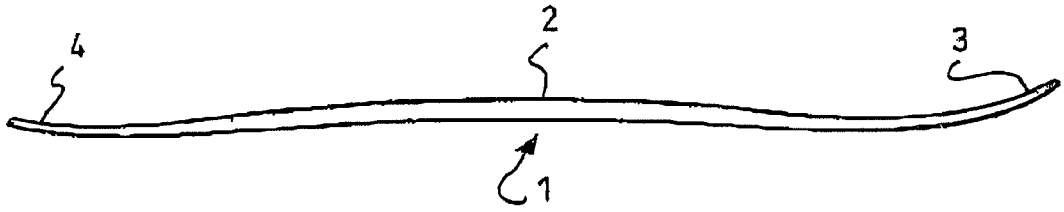
FIG. 1 is a general view of a ski.

With reference to FIG. 1, the ski 1 shown is an elongated beam defining a longitudinal direction and including a central zone 2 or the waist, a curved shovel 3 and a tail 4. The beam is cambered lengthwise, with a shovel raised with respect to a horizontal plane on which the ski rests.

The beam of the ski is structural, viz., it is made of a plurality of components which contribute to providing it with predetermined static and dynamic mechanical properties.

Figure 2:
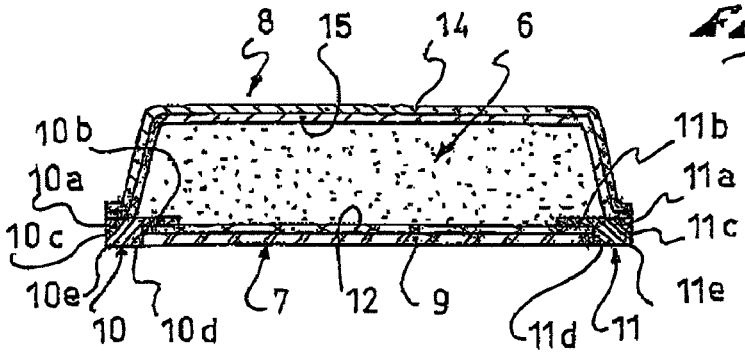
FIG. 2 is a transverse cross-sectional view of the ski of FIG. 1.

In cross section, the structure of the ski of FIG. 2 is formed of a central core 6 that rests on a lower sub-assembly 7 and is covered by an upper sub-assembly 8. The core forms a sort of spacer between the two sub-assemblies.

The core can be of any appropriate type. It can be shaped by machining, for example, and be made of wood or polyurethane foam. The core can also be injected in a ski manufacturing mold after the various ski components have been positioned. Conventionally, the lower sub-assembly includes a bottom gliding element 9, or sole, bordered by two lateral running edges 10 and 11. The bottom gliding element can be made of any appropriate material, for example, such as polyethylene possibly loaded with additional powders.

The bottom gliding element is covered by the lower reinforcing structure 12, which includes one or several superimposed reinforcing layers, the lower reinforcing structure being shown in FIG. 2 to be parallel to the bottom gliding element and extends from one of the running edges 10, 11 to the other.

The reinforcing layer(s) can be of any appropriate type. For example, they can be formed as a reinforcement made of fibers embedded in a resin matrix or they can be metallic plates. The fibers can be glass fibers, carbon fibers, aramid fibers, or fibers made of other appropriate material. Mixtures of fibers of different types can be used in the reinforcements. For a metal reinforcement, a layer of aluminum alloy, steel, or amorphous metal can be used.

The upper sub-assembly includes an outer decorative layer made of a thermoplastic material, for example, such as polyurethane, polyamid-11, polyamid-12, or the like, or ABS or ABS/PU. The decorative layer can be complex, viz., formed by superimposing unitary films. It can be decorated by any appropriate means, such as by silk screen printing or sublimation.

Beneath the decorative layer 14, the upper sub-assembly 8 includes an upper reinforcing structure 15 formed of one or several reinforcing layers. As for the lower sub-assembly, the reinforcing layers can be composite or metallic, or a combination of these materials. The non-limiting structure shown in FIG. 2 is that of a cap ski, whereby the reinforcing structure 15 extends downwardly at the sides of the ski toward or to the running edges 10, 11.

Additional reinforcing layers can be provided locally, especially in the waist zone, for the lower and upper reinforcing structures.

Conventionally, the various components of the ski are positioned in a mold and are assembled to one another by means of resin that forms the matrix of the reinforcing layers, and/or by means of sheets of glue that are inserted between the various layers, or yet by means of the material of the core, for a ski having an injected core.

The structure of the ski is not limiting, and other ski construction methods are suitable and within the scope of the invention. For example, the ski can have a sandwich structure or a torsion box structure.

Conventionally, the running edges are made of metal, or of another material that is different from the materials used for the other components of the ski.

Each running edge has an edge body 11*a*, 10*a*, respectively, and an anchoring blade 11*b*, 10*b*, respectively. The edge bodies have a polygonal cross-section, as well as surfaces 11*c*, 11*d*, 10*c*, 10*d*, which are visible from the outside and form, therebetween, a ridge 11*e*, 10*e* which form the bottom extremities which extend along the length of the ski.

The anchoring blades 11*b*, 10*b*, or flanges, are raised with respect to the gliding surface defined by the bottom gliding element of the ski, and are opposite one another, parallel to the plane defined by the gliding surface. In the illustrated embodiment, the upper surface of each of the blades 11*b*, 10*b* is coextensive with the upper surface of the body 11*a*, 10*a* of its respective running edge and the upper surfaces of the two blades 11*b*, 10*b* are themselves co-planar, although transversely spaced apart. The anchoring blades 11*b*, 10*b* have recesses, i.e., hollowed-out areas or scallops, 11*f*, 10*f*, evenly distributed along each of the running edges. These scallops are particularly visible in FIG. 3. The scallops can be open or closed. In the embodiment shown in FIG. 3, they are open.

A connecting element, or connecting arrangement, connects the running edges 10 and 11 by means of the anchoring blades. The connecting element is oriented to be coextensive with the anchoring blades. That is, a plane defined by the anchoring blades 10*b*, 11*b* of the running edges 10, 11 either extends along and through the connecting element or is parallel to the connecting element, or is substantially parallel to the connecting element. In the example shown in FIG. 3, described further below, the connecting element 20 includes anchoring segments 20*a*, each of which extends from a fastening end at one of the running edges to a fastening end at the other, at locations that are spaced from one another to form a sort of lacing between the running edges, with longitudinally successive segments 20*a* alternately resting on the upper and lower surfaces of the anchoring blades 10*b*, 11*b* of the running edges 10, 11. The segments can be transversely oriented from one running edge to the other, i.e., perpendicular to the longitudinal direction defined by the beam of the ski, or they can be oriented obliquely. The segments can also be crisscrossed. They can be independent unitary elements or a plurality of segments can originate from a common sub-assembly. Rather than resting on the upper and lower surfaces of the anchoring blades, independent unitary elements shown in FIG. 5, described further below, extend in alignment with the anchoring blades of the running edges. For a pair of skis, the connecting segments of each of the skis can be situated in an asymmetrical arrangement with respect to the longitudinal direction of the ski, and they can be in a symmetrical arrangement from one ski to the other.

The connecting element, in a particular embodiment, is thin and flexible and can be a filament or a braid, for example. Alternatively, the connecting element can be rigid and be a metal strip or band, for example. By extending from one running edge to the other, the connecting element forms a series of connecting segments that connect the two running edges. In this way, it integrates into the structure of the ski without requiring any particular arrangement, or rearrangement, of the structure, and it is flexible along the longitudinal direction of the ski, i.e., along its length, in order to accommodate the flexing movements of the ski without providing significant opposing resistance. The connecting segments are inextensible and are tensioned between the two running edges, without being pre-tensioned at rest, according to a particular embodiment, so that the connecting element maintains the two running edges in relation to one another, and so that it opposes the local separation, or detachment, of one running edge by returning the detachment forces directly to the other running edge which itself takes support on the structure of the ski.

Figure 3:
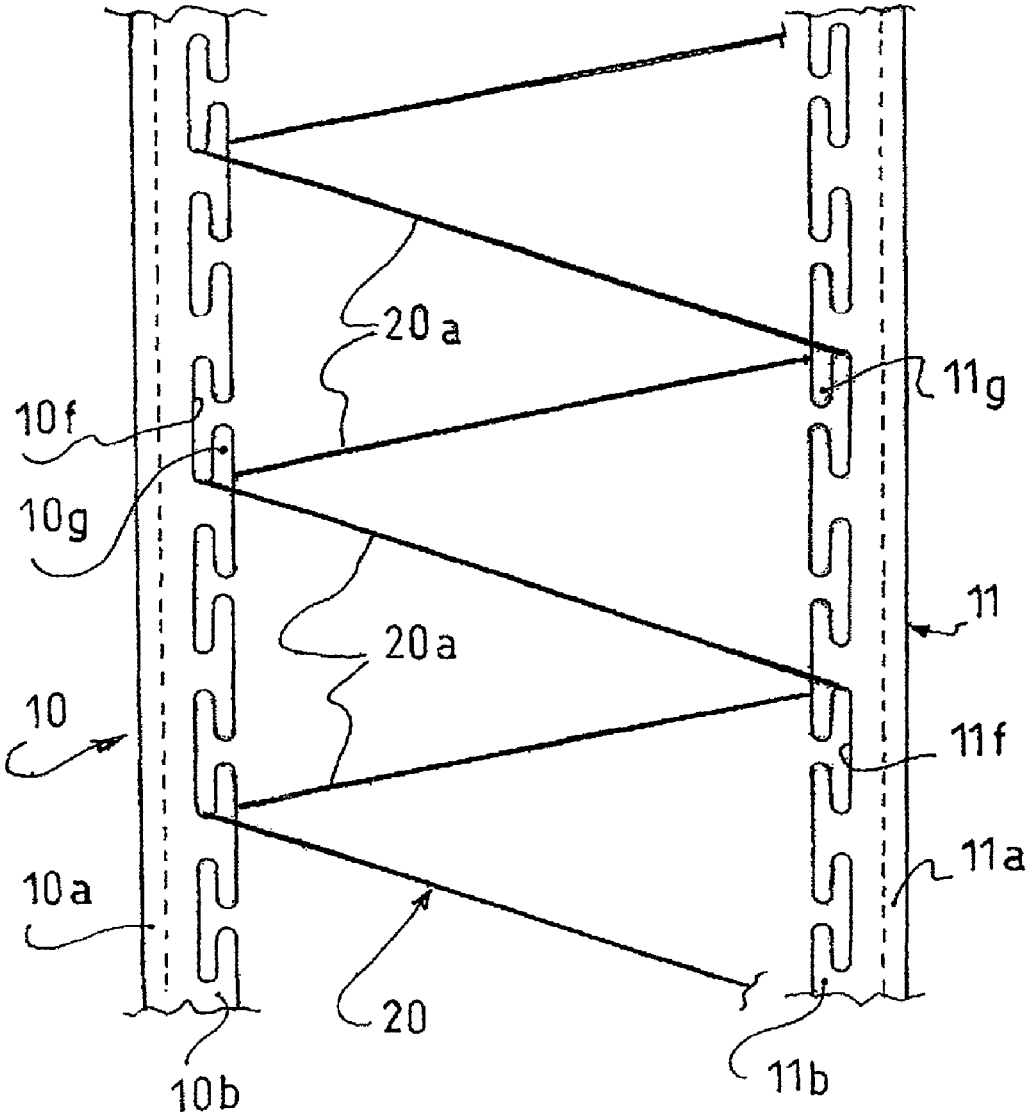
FIG. 3 shows a first embodiment of the invention.

FIG. 3 illustrates a first embodiment of the invention. A thread or filament 20 is tensioned between the running edges and is attached in the prongs 10*g*, 11*g* that demarcate the scallops 10*f*, 11*f* of the running edges. The filament zigzags between the running edges by forming a continuous series of anchoring segments 20*a* that extend in the extension of the blades, and the ends of which are located sometimes above and sometimes beneath the blade.

The scallops can be closed, in which case the filament is inserted in the holes of the scallops. In a general sense, the prongs and the scallops can be regarded as a mechanical fastening structure of the anchoring blade or flange 11*b*, 10*b*, for facilitating the fastening of connecting element(s). The expression "fastening structure" is intended to refer to a structure in contrast to a blade or flange of a running edge having uninterrupted surfaces along its length which would offer no mechanical structure by which a connecting element, such as filament 20, can be retained or secured.

Any type of filament or braid is suitable for the embodiment of FIG. 3, including a nylon thread, a braid of aramid fibers, a metallic braid, or the like. The filament can be simple, as shown, or crisscrossed, in the manner of a shoe lace. The filament extends over the entire or only a portion of the length of the running edges and, in the latter case, in a particular embodiment, it covers at least the waist zone, which is the most exposed zone of the ski. Also, it is possible to vary, over the length of the ski, the angle formed by the various connecting segments with the longitudinal direction of the ski by skipping a more or less substantial number of scallops between two successive fastening zones. The ends of the filament are fastened by any appropriate means, such as a knot, for example. It is also possible to make a knot in the area of the passage into the scallops of the running edges.

A flexible filament is advantageous because the length of the connecting segments adjusts itself as a function of the spacing of the points for fastening to the running edges. Thus, the same type of filament can be used for a line of skis of various lengths, or for skis having different dimension lines. Also, due to its flexibility, the filament does not oppose any resistance to the bending of the ski. Therefore, its presence does not alter the mechanical properties of the ski. During the manufacture of the ski, the filament is integrated and embedded in the element(s) that are in contact with the anchoring blades, and on which the blades take support. For example, the filament becomes embedded in a reinforcing layer, a layer of glue, or yet in the core, for a ski having an injected core.

FIG. 4 relates to another embodiment of the invention. The two running edges 110 and 111 are locally connected by a connecting element 120 formed by a series of independent connecting strips 120*a*, which each form a connecting segment, or anchoring segment. The strips 120*a* are thin and oriented transversely, generally perpendicular to the length of the running edges. The ends of the connecting strips 120*a* are engaged and retained in the scallops 110*f* and 111*f* of the running edges. For example, the ends are bent so as to form an L-shape or a hook, or the fastening is done by means of an attached metallic pin which could be inserted within a scallop. The connecting strips rest on the top or the bottom, irrespectively, of the anchoring blades, or flanges, of the running edges 110, 111. Other fastening means are also suitable within the scope of the invention.

As in the preceding case, the connecting strips 120*a* can be positioned at variable distances by skipping a more or less substantial number of scallops between two successive strips. The strips can be oriented obliquely relative to the longitudinal direction.

An alternative construction is illustrated in FIG. 5. The scallops 210*f* and 211*f* of the running edges 210 and 211 are open. The strip 220*a*, or anchoring segment, of the connecting element 220, or connecting arrangement, has a fastening head 220*b*, 220*c* at each of its ends, which is nested in a recess, or scallop, of one or the other of the blades/flanges of the running edges in the manner of a piece of a jig-saw puzzle. In this way, the strip 220*a* is co-extensive with, and in alignment with, the blades/flanges of the running edges. Stated differently, while consistent with the description above, a plane defined by the anchoring blades of the running edges 210, 211 extends along and through the connecting element 220 (more particularly, along and through the segments 220*a* of the connecting element 220), inasmuch as the segments 220*a* and their fastening heads 220*b* and 220*c* are in the plane of the anchoring blades of the running edges.

Other modes of construction are also possible.

The present description is only provided by way of example, and other embodiments of the invention could be adopted without leaving the scope thereof. In particular, the invention also applies to snowboards and, generally speaking, to any gliding board that is provided with lateral running edges. For example, the upper surface of a ski has a width to support only one of the skier's boots and the upper surface of a snowboard has a width sufficient to support both of the rider's boots, particularly oriented other than longitudinally.

The invention also applies to boards, the running edges of which are formed by a series of butt-joined running edge sections.

The invention claimed is:

1. A gliding board comprising:

an elongated structural beam having a length defining a longitudinal direction;

a bottom gliding element having a pair of transversely opposed sides;

a lower reinforcement structure;

a lateral running edge extending along each of the sides of the bottom gliding element, each said running edge having a body and an anchoring blade, the anchoring blades of the running edges being oriented opposite one another and each of the anchoring blades projecting from a respective body laterally inwardly within the beam;

an inextensible connecting element connecting the anchoring blades of the opposed running edges at least along a portion of the length of the beam;

said connecting element comprising a plurality of anchoring segments, each of the plurality of anchoring segments extending between, anchored to, and oriented co-extensive with the anchoring blades to be tensioned to oppose separation forces of the anchoring blades;

the anchoring segments of the connecting element being oriented in the extension of, or in the extension and alignment of, the anchoring blades.

2. A gliding board according to claim 1, wherein:

each of the anchoring blades projects from a respective running edge body toward the other anchoring blade and includes a top and a bottom;

the anchoring segments rest on the top or on the bottom of the anchoring blades.

3. A gliding board according to claim 1, wherein:

the anchoring segments are tensioned, without being pretensioned at rest.

4. A gliding board according to claim 1, wherein:

the connecting element is fastened to the running edges at a plurality of locations along the length of the beam;

a spacing between successive fastening locations varies along the length of the beam.

5. A gliding board according to claim 1, further comprising:

an upper reinforcement structure extending downwardly at opposite sides of the gliding board toward the running edges.

6. A gliding board according to claim 5, further comprising:

a core positioned between the upper reinforcing structure and the lower reinforcing structure.

7. A gliding board according to claim 1, wherein:

the lower reinforcing structure is parallel to the bottom gliding element and extends from one of the running edges to the other.

8. A gliding board according to claim 1, wherein:

the gliding board is a ski having a width to support only a single boot oriented along the length of the beam.

9. A gliding board according to claim 1, wherein:

the gliding board is a snowboard having a width to support both of a rider's boots.

10. A gliding board according to claim 1, wherein:

each of the plurality of anchoring segments extends from one of the lateral running edges to the other of the lateral running edges;

the plurality of anchoring segments are successively longitudinally spaced apart.

11. A gliding board comprising:

an elongated structural beam having a length defining a longitudinal direction;

a bottom gliding element having a pair of transversely opposed sides;

a lower reinforcement structure;

a lateral running edge extending along each of the sides of the bottom gliding element, each said running edge having a body and an anchoring blade, the anchoring blades of the running edges being oriented opposite one another and each of the anchoring blades projecting from a respective body laterally inwardly within the beam;

an inextensible connecting element connecting the anchoring blades of the opposed running edges at least along a portion of the length of the beam;

said connecting element comprising a plurality of connecting segments, the connecting segments being oriented co-extensive with the anchoring blades to be tensioned to oppose separation forces of the anchoring blades;

the connecting segments of the connecting element being oriented in the extension of, or in the extension and alignment of, the anchoring blades;

the connecting element being formed by a filament.

12. A gliding board according to claim 11, wherein:

the running edges include scallops;

the filament is fastened to ones of the scallops.

13. A gliding board according to claim 12, wherein:

the filament zigzags between the running edges.

14. A gliding board comprising:

an elongated structural beam having a length defining a longitudinal direction;

a bottom gliding element having a pair of transversely opposed sides;

a lower reinforcement structure;

a lateral running edge extending along each of the sides of the bottom gliding element, each said running edge having a body and an anchoring blade, the anchoring blades of the running edges being oriented opposite one another;

the running edges include scallops;

the filament is fastened to ones of the scallops;

an inextensible connecting element connecting the anchoring blades of the opposed running edges at least along a portion of the length of the beam;

said connecting element comprising a plurality of connecting segments, the connecting segments being oriented co-extensive with the anchoring blades to be tensioned to oppose separation forces of the anchoring blades;

the connecting segments of the connecting element being oriented in the extension of, or in the extension and alignment of, the anchoring blades;

the connecting element being formed by a filament;

the filament zigzags between the running edges.

15. A gliding board comprising:

an elongated structural beam having a length defining a longitudinal direction;

a bottom gliding element having a pair of transversely opposed sides;

a lower reinforcement structure;

a lateral running edge extending along each of the sides of the bottom gliding element, each said running edge having a body and an anchoring blade, the anchoring blades of the running edges being oriented opposite one another;

an inextensible connecting element connecting the anchoring blades of the opposed running edges at least along a portion of the length of the beam;

said connecting element comprising a plurality of connecting segments, the connecting segments being oriented co-extensive with the anchoring blades to be tensioned to oppose separation forces of the anchoring blades;

the connecting segments of the connecting element being oriented in the extension of, or in the extension and alignment of, the anchoring blades;

the running edges including scallops;

the connecting element including a plurality of distinct strips, each of said strips having two ends, each said end being engaged in one of the scallops of a respective one of the two running edges.

16. A gliding board comprising:

an elongated structural beam having a length defining a longitudinal direction;

a bottom gliding element having a pair of transversely opposed sides and a lower gliding surface;

a lateral running edge extending along each of the sides of the bottom gliding element, each said running edge having a body and an anchoring flange extending from the body toward the other running edge;

each of the anchoring flanges having a mechanical fastening structure at least along a portion of the length of the beam;

an inextensible connecting arrangement connecting, with the mechanical fastening structures of the anchoring flanges, the anchoring flanges of the opposed running edges at least along said portion of the length of the beam;

said connecting arrangement comprising a plurality of anchoring segments oriented co-extensive with the anchoring flanges and constructed and arranged with the mechanical fastening structure of the anchoring flanges to be in tension to oppose separation forces of the anchoring flanges.

17. A gliding board according to claim 16, wherein:

the anchoring segments are oriented coextensive with, and in alignment with, the anchoring blades.

18. A gliding board according to claim 16, wherein:

said anchoring flanges have upper surfaces extending generally parallel to the gliding surface of the bottom gliding element.

19. A gliding board according to claim 18, further comprising:

a lower reinforcing structure parallel to the bottom gliding element, said lower reinforcing structure extending from one of the running edges to the other.

20. A gliding board according to claim 16, wherein:

each of the plurality of anchoring segments extends from one of the lateral running edges to the other of the lateral running edges;

the plurality of anchoring segments are successively longitudinally spaced apart.

21. A gliding board according to claim 16, wherein:

the mechanical fastening structure of each of the anchoring flanges comprises successive recesses in the anchoring flange for cooperation with the anchoring segments to anchor the anchoring segments to the anchoring flanges.

22. A gliding board comprising:

an elongated structural beam having a length defining a longitudinal direction;

a bottom gliding element having a pair of transversely opposed sides;

a lower reinforcement structure;

a lateral running edge extending along each of the sides of the bottom gliding element, each said running edge having a body and an anchoring blade, each of the anchoring blades of the running edges projecting from a respective lateral running edge body toward another of the anchoring blades;

an inextensible connecting arrangement comprising a plurality of anchoring segments anchoring the anchoring blades of the opposed running edges at least along a portion of the length of the beam;

the plurality of anchoring segments being oriented in the extension and alignment of the anchoring blades.

* * * * *